United States Patent [19]

Poppitz

[11] Patent Number: 4,629,347

[45] Date of Patent: Dec. 16, 1986

[54] FLUID AND BRUSH CLEANING APPARATUS

[76] Inventor: Harold A. Poppitz, 12502 Xenwood Ave. South, Savage, Minn. 55378

[21] Appl. No.: 685,897

[22] Filed: Dec. 24, 1984

Related U.S. Application Data

[63] Continuation-in-part of Ser. No. 521,989, Aug. 11, 1983, abandoned.

[51] Int. Cl.[4] ..... A46B 11/00; A46B 11/06

[52] U.S. Cl. ..... 401/42; 401/43; 401/138; 401/140; 401/270; 401/277; 401/285; 401/287; 401/288; 401/289; 239/310

[58] Field of Search ..... 401/42, 285, 287, 288, 401/289, 286, 140, 138, 204, 203, 277, 270, 40, 43; 417/181, 191; 239/310

[56] References Cited

U.S. PATENT DOCUMENTS

| | | | |
|---|---|---|---|
| 945,238 | 1/1910 | Lange | 401/270 X |
| 1,091,888 | 3/1914 | Lorzing | 401/288 |
| 1,199,646 | 9/1916 | Witherly | 401/285 X |
| 1,205,681 | 11/1916 | Sundstrand | 401/289 |
| 1,277,804 | 9/1918 | Wingers | 401/289 |
| 1,486,722 | 3/1924 | Bernat | 401/287 |
| 1,560,841 | 11/1925 | Nearn | 401/277 |
| 1,568,602 | 1/1926 | Harris | 401/288 X |
| 1,577,192 | 3/1926 | Rapisardi | 401/277 |
| 1,812,457 | 6/1931 | Tavalin | 401/287 |
| 1,977,183 | 10/1934 | Friedman | 401/277 X |
| 2,281,484 | 4/1942 | Ellinger | 401/42 X |
| 2,381,589 | 8/1945 | Hayes | 417/181 |
| 2,448,607 | 9/1948 | Logan | 401/289 |
| 2,685,702 | 8/1954 | Jones | 401/289 |
| 3,084,634 | 4/1963 | McDougall | 417/191 X |
| 3,613,997 | 10/1971 | Thompson | 239/310 |
| 3,748,050 | 7/1973 | Poppitz | 401/289 |
| 3,806,037 | 4/1974 | Loewenkamp | 239/310 |
| 3,829,019 | 8/1974 | Petsch | 239/251 |
| 3,829,024 | 8/1974 | Heden | 239/310 |
| 3,832,069 | 8/1974 | Petsch | 401/289 |

FOREIGN PATENT DOCUMENTS

| | | | |
|---|---|---|---|
| 911307 | 7/1946 | France | 417/181 |
| 651468 | 1/1963 | Italy | 401/42 |

OTHER PUBLICATIONS

Chaska Chemical Company, Inc. brochure, "The Beautiful One".

*Primary Examiner*—Steven A. Bratlie
*Attorney, Agent, or Firm*—Burd, Bartz & Gutenkauf

[57] ABSTRACT

A fluid pressure cleaning apparatus for cleaning large or inaccessible surfaces, such as a floor or truck sidewall. A housing has a manifold assembly mounted in the interior thereof with a plurality of linearly aligned spray nozzles spaced apart to provide a continuous spray or curtain of cleaning fluid to the surface to be cleaned. Portions of the manifold assembly extend through the housing and are connected to a handle assembly. A first brush array lines the outer edges of the housing and confines the spray from the manifold assembly and assists in cleaning the surface. A second array of scrub brushes is provided within the periphery of the first array. In one form of the cleaning apparatus the manifold assembly has a fluid discharge port and a valve selectively operable to open and close the port. When the valve is closed high pressure fluid is discharged from the nozzles to wash and rinse the surface. Detergent and fluid is directed unto the surface when the valve is open.

34 Claims, 14 Drawing Figures

FIG.1
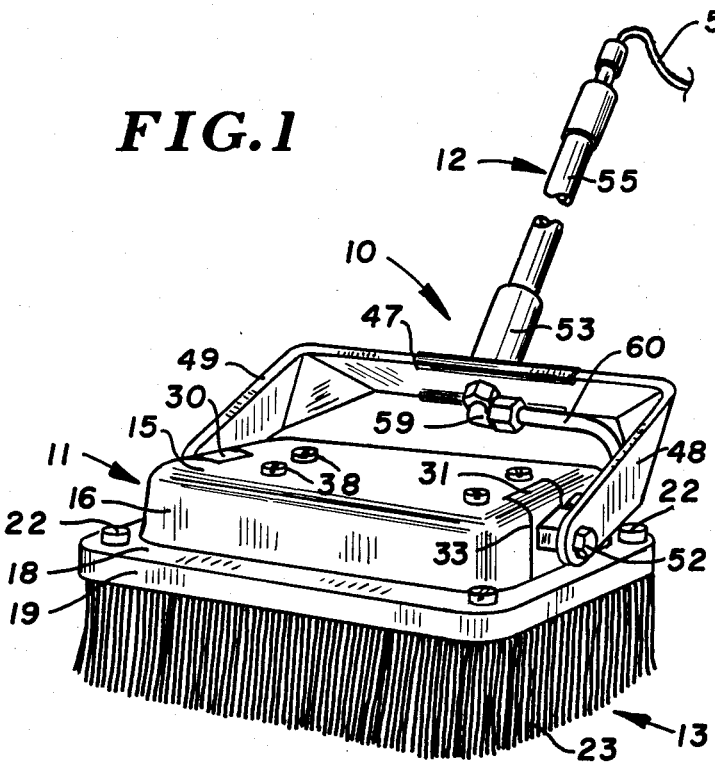
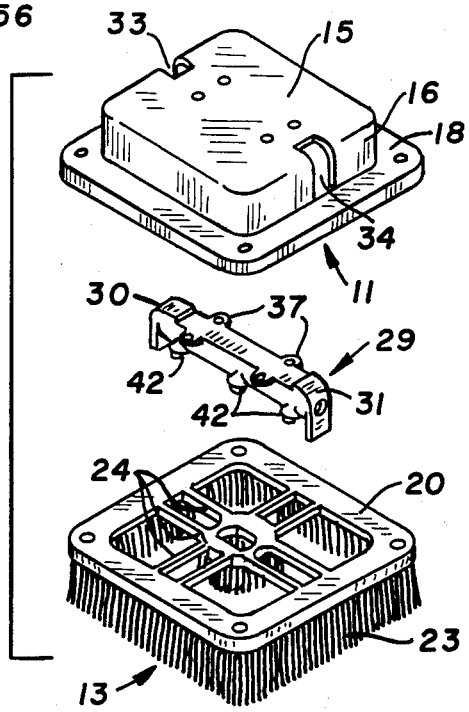
FIG. 9
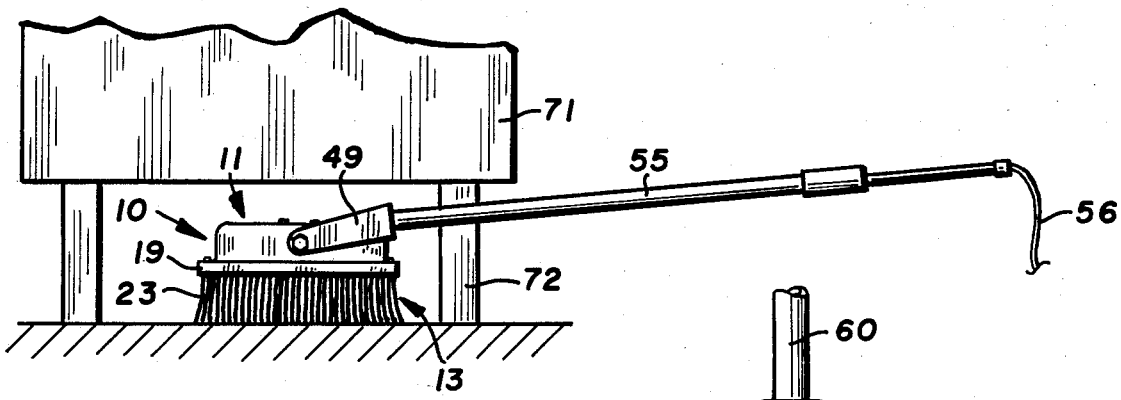
FIG.2
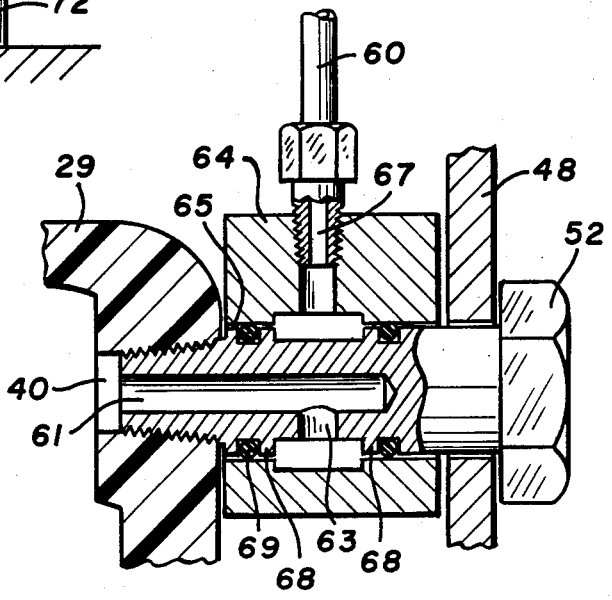
FIG.10

FLUID AND BRUSH CLEANING APPARATUS

CROSS REFERENCE TO RELATED APPLICATION

This application is a continuation-in-part of U.S. application Ser. No. 521,989 filed Aug. 11, 1983, now abandoned.

FIELD OF THE INVENTION

The field of the invention relates to fluid pressure cleaning equipment having a hand movable housing equipped with a brush and a liquid dispenser to clean a surface.

BACKGROUND OF THE INVENTION

High fluid pressure cleaning devices that are popular for cleaning large surface areas commonly are of a type using a scrub brush array in combination with a source of cleaning fluid under high pressure. The cleaning fluid is usually water mixed with soap, detergents or other cleaning compounds. The convenience of such devices is enhanced by long handles enabling cleaning of large or remote and inconveniently accessible places. Due to the large fluid usage involved, it is preferable that such devices work efficiently both in terms of neatness and fluid conservation. Examples of prior manually movable fluid cleaners are disclosed by Poppitz in U.S. Pat. No. 3,748,050 and Petsch in U.S. Pat. Nos. 3,829,019 and 3,832,069.

SUMMARY OF THE INVENTION

The invention pertains to a fluid pressure cleaning apparatus for cleaning of large or inconveniently accessible surfaces which can be horizontally, vertically or diagonally orientated and can be flat and smooth or irregular. The cleaning apparatus is constructed of easily assembled preformed elements or parts including a housing, a brush assembly, a fluid manifold assembly and a yoke and handle assembly. The fluid delivery manifold assembly can snap into an upper portion of the housing on the interior thereof and has a plurality of downwardly directed, aligned fluid discharge nozzles. The manifold assembly connects to fluid delivery conduits associated with the handle assembly. A yoke is connected by bolts to portions of the manifold assembly extending through the housing, and an elongate handle is connected to the yoke. A lower portion of the housing connects to a scrub brush assembly, which includes an outer perimeter or array of scrub brushes and an inner array of scrub brushes that work in cooperation with the fluid discharge nozzles to clean a surface. The fluid discharge nozzles provide a generally linear curtain of cleaning fluid to complement scrubbing by the brushes. The fluid and brush cleaning apparatus is usable with hydraulic fluid, such as water, to loosen dirt and greases on the surfaces and effectively clean these surfaces. The pressure of the fluid and the scrubbing action of the brushes allows efficient cleaning with a minimum amount of fluid.

In one modification of the fluid and brush cleaning apparatus, the manifold assembly has a separate fluid outlet port and a valve operable to selectively open and close the port. When the port is open the pressure of the fluid within the fluid system is low and the flow rate of the fluid is increased. A detergent is drawn into the fluid when the valve is open. A control operable in response to an increase in the fluid pressure cuts off the detergent. The fluid under high pressure is discharged from nozzles to scrub and rinse the surface that is being cleaned.

IN THE DRAWING

FIG. 1 is a perspective view of a cleaning apparatus according to one form of the invention;

FIG. 2 is a side elevational view of the cleaning apparatus of FIG. 1 positioned to perform a cleaning procedure beneath a piece of furniture;

FIG. 9 is an exploded view of portions of the cleaning apparatus;

FIG. 10 is an enlarged view partly in section showing the fluid connection of the first bolt to the manifold block of FIG. 5;

DESCRIPTION OF A PREFERRED EMBODIMENT

Figure 3:
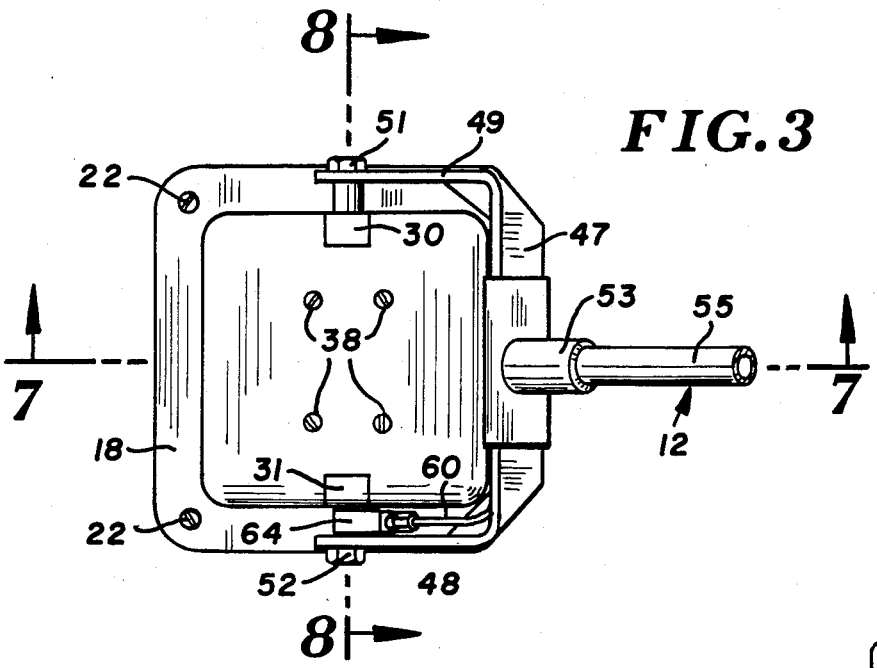
FIG. 3 is a top plan view of the cleaning apparatus of FIG. 1 with the handle portion foreshortened.

Referring to the drawing, there is shown in FIG. 1 a fluid and brush cleaning apparatus 10 according to the invention in a generally upright orientation preparatory to cleaning a horizontal surface although apparatus 10 is also usable for cleaning vertical, diagonal and irregular surfaces. Apparatus 10 is also used to clean tile floors. Apparatus 10 includes a shroud or housing 11 that can be manipulated by a handle assembly 12 to move a scrub brush assembly 13 over a surface to be cleaned. Brush assembly 13 acts in conjunction with a source of pressure cleaning fluid, such as water, to accomplish a cleaning task.

Housing 11 has a generally square and pan-shaped structure having a top wall 15 joined to a continuous sidewall 16. A ledge 18 extends outwardly from the lower edge of sidewall 16 opposite top wall 15 and terminates in a right angle lip 19 which is parallel to sidewall 16. The inner surfaces of ledge 18 and lip 19 form a seat to accommodate a brush frame 20 of brush assembly 13.

Figure 7:
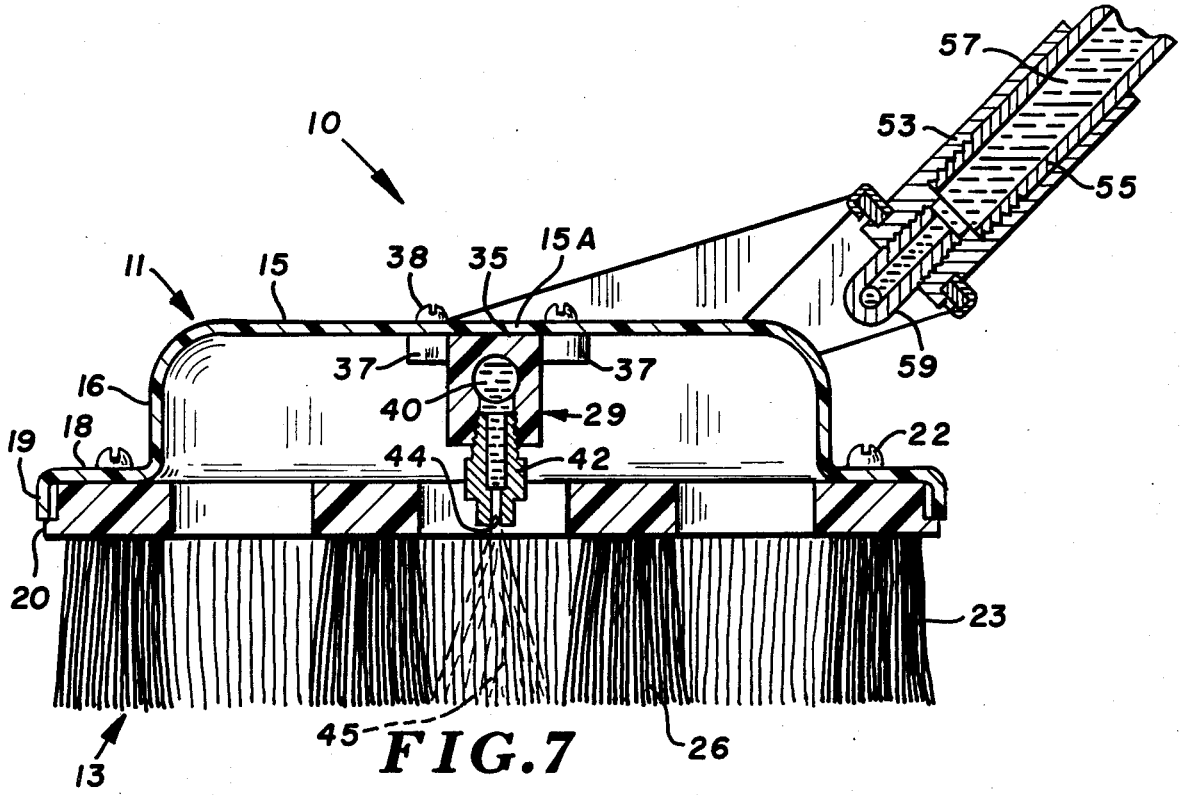
FIG. 7 is an enlarged sectional view of th cleaning apparatus of FIG. 3 taken along the line 7—7 thereof.
Figure 8:
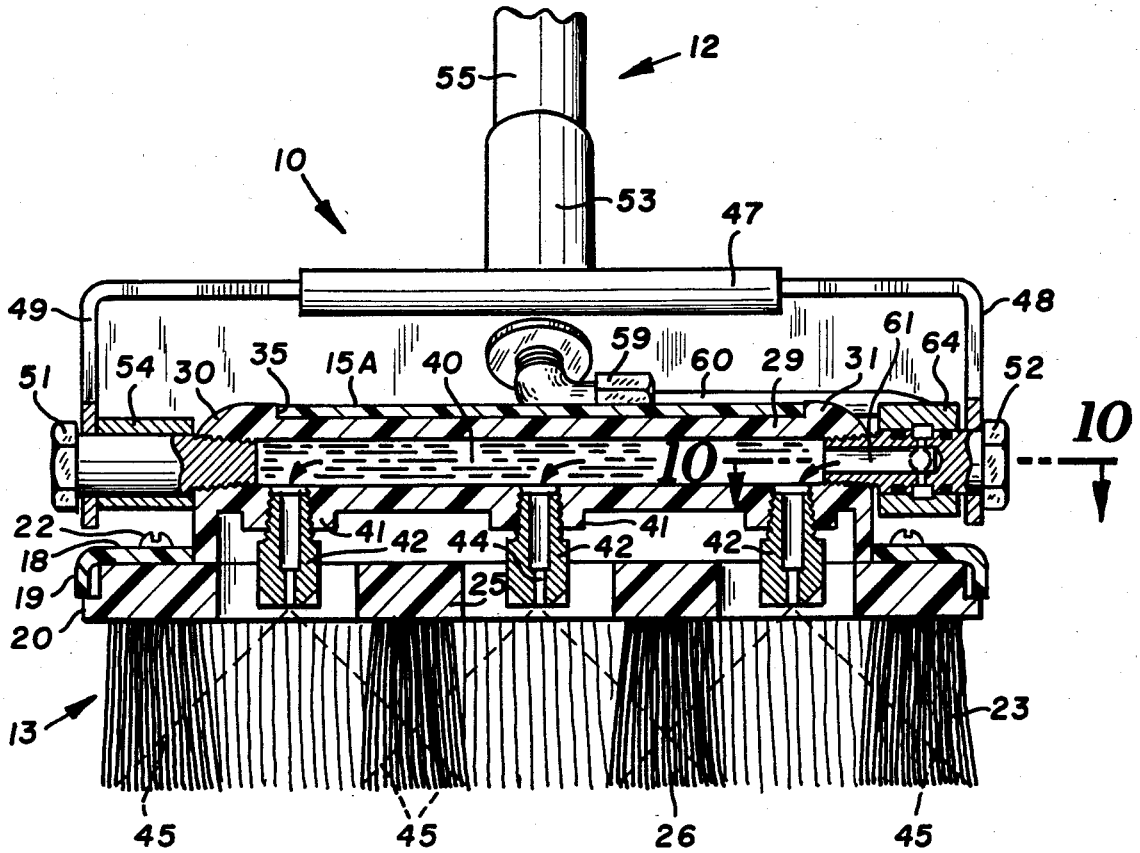
FIG. 8 is an enlarged sectional view of the cleaning apparatus of FIG. 3 taken along the line 8—8 thereof.

As shown in FIGS. 7, 8 and 10, the brush frame includes an outer peripheral open square frame member 20 shaped to sit inside the seat formed by ledge 18 and lip 19. A plurality of fasteners, such as bolts or screws 22, hold frame member 20 on ledge 18 of housing 11. Frame member 20 carries a first array of brushes 23 disposed continuously along the lower surface thereof forming a continuous uninterrupted brush wall along the lower outer perimeter of housing 11. Brushes 23 are fastened in any usual and referred manner to the outward surface of frame member 20 and extend downwardly therefrom when apparatus 10 is in an upright orientation like that shown in FIG. 1.

Figure 6:
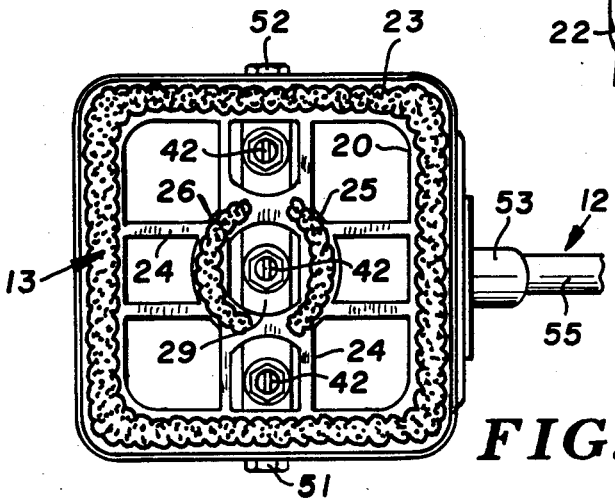
FIG. 6 is a bottom plan view of the cleaning apparatus of FIG. 5.

As shown in FIG. 6, rib structure 24 extends inwardly from outer frame member 20 and connects to an inner generally circular frame member 25. A second or inner array of brushes 26 are mounted on frame member 25. The inner array of brushes 26 complements the first or outer array of brushes 23 and is arranged in a pattern that is generally circular but having diametrically opposite interruptions or gaps as will be more fully described. Brush frame 20 is readily assembled and disassembled from housing 11 for the ease of construction of cleaning apparatus 10.

As shown in FIGS. 7 and 8, a manifold assembly of cleaning apparatus 10 includes an elongate manifold block 29 assembled to the interior surface of top wall 15 of housing 11 and extending end to end between opposite portions of sidewall 16. As shown in FIGS. 8 and 9, manifold block 29 has first and second rounded end shoulders 30, 31 which terminate in downwardly directed legs. As shown in FIG. 9, housing 11 has first and second side openings 33, 34 each of which extends from top wall 15 down along the sidewall 16 terminating at the ledge 18. Manifold block 29 is adapted to be snapped into place with respect to housing 11 with the rounded portion of the shoulders 30, 31 occupying the space created at the respective housing openings 33, 34 such that the shoulders are generally flush with top wall 15 and sidewall 16. Adjacent edges of sidewall 16 hold shoulders 30 and 31 in place. In such assembled relationship, the lower leg portions of shoulders 30, 31 are flush with ledge 18. As shown in FIGS. 7 and 8, manifold block 29 has an upper recess 35 extended between the shoulders 30, 31 straddling that portion of the top wall 15A located between openings 33, 34 and between shoulders 30, 31 when manifold block is in assembled relationship with housing 15. Ears 37 attached to block 29 extend from the upper portion or top surface of recess 35 of manifold block 29 for connection with screws 38 extended through the top wall 15 to further hold manifold block 29 in place.

Manifold block 29 has an elongate, longitudinal manifold chamber 40 extending the length thereof. A plurality of downwardly directed bosses 41 are spaced apart on the bottom of manifold block 29. Each boss 41 has a female threaded opening open to manifold chamber 40. A plurality of spray nozzles 42 are threadably mounted on bosses 41. Each nozzle 42 has a downwardly directed passage and an orifice 44. Spray nozzles 42 are positioned to direct a curtain or wall of fluid under pressure to the area encompassed by outer brush array 23 of brush assembly 13. The spray orifices 44 are open to manifold chamber 40 and direct a discharge of fluid into the area encompassed by the brush array 23 and 26. Nozzles 42 terminate in the proximity of peripheral frame member 20 of brush assembly 13.

Referring to FIGS. 6 and 8, nozzles 42 are linearly aligned and regularly spaced apart transversely across the approximate mid-portion of housing 11. One of the nozzles 42 is located in the center of manifold block 29 and the remaining two nozzles 42 are located in opposite end sections of block 29. Additional bosses 41 and nozzles can be used with manifold block 29. The orifices 44 can be round or slits. Nozzles 42 are conventional spray nozzles. The diametrically opposite, circumferential interruptions of inner brush array 26 occur on the alignment of nozzles 42. Nozzles 42 as positioned are operative to provide together a continuous wall or curtain of fluid transversely across housing 11 and bounded by opposite portions of the first brush array 23 as indicated at 45 in phantom lines in FIGS. 7 and 8.

Handle assembly 12 includes a yoke 47 connected to flat, parallel spaced apart legs 48, 49 having ends adapted to straddle housing 11. The ends of the legs 48, 49 are connected to manifold block 29 by first and second connecting bolts 51 and 52. The ends of manifold chamber 40 extend through shoulders 30, 31 and are inwardly threaded so as to receive the exteriorly threaded ends of bolts 51 and 52 as shown in FIG. 8. Bolts 51 and 52 pass through suitable holes provided in the ends of legs 48 and 49 so as to permit pivotal movement of legs 48 and 49 and yoke 47 with respect to housing 11. A tubular sleeve 54 surrounding bolt 51 spaces leg 49 from shoulder 30.

A tubular collar 53 fixed to yoke 47 of handle assembly 12 accommodates one end of an elongate tubular handle 55. Collar 53 spaces leg 48 from shoulder 31. The opposite end of tubular handle 55 is connected to a fluid supply line 56 for the supply of a cleaning fluid under pressure from a remote source (not shown). The source of the cleaning fluid can be a pump operable to pump fluid from a tank or supply line to handle 55.

Referring to FIG. 7, the lower end of tubular handle 55 has external threads which engage internal threads located in collar 53. Tubular handle 55 has an axial fluid passage 57 for delivery of fluid discharged from the fluid supply line 56. One end of an elbow connector 59 is threadably engaged in the opposite end of collar 53 and has an axial passage for transfer of cleaning fluid delivered through the fluid passage 57 of handle 55. Elbow connector 59 makes a right angle turn from collar 53 and connects to a fluid delivery line 60.

As shown in FIG. 10, connecting bolt 52 has a central fluid passage 61 open to chamber 40 of manifold block 29. A plurality of radial apertures 63 extend through the sidewall of the shank of bolt 51 and are open to the central fluid passage 61. A connecting block 64 has an axial bore 65 which surrounds the intermediate portion of the shank of connecting bolt 51 including the vicinity of radial apertures 63. Connecting block 64 also has a fluid passage 67 which connects at one end with the opposite end of fluid line 60 and is open to central bore 65 whereby fluid delivered from fluid line 60 passes through the fluid passage 67 into central bore 65, then through the radial apertures 63 and the central fluid passage 61 of connecting bolt 51, to manifold chamber 40. On either side of fluid passage 67 of connecting block 64 and the radial aperture 63 of bolt 51, bolt 51 is provided with circumferential ribs 68 which provide annular seats for fluid sealing O-rings 69. The O-rings 69 are positioned in sealing relationship between the surface of the shank of bolt 51 and the interior surface of connecting block 64 defining the axial bore 65.

In use, cleaning fluid under pressure is supplied through supply hose 56 to tubular handle 55. The cleaning fluid is preferably a liquid, such as water, mixed with a detergent. The fluid is supplied under pressure, for example 200 to 400 psi. The fluid travels through the elbow connector 59 and through the fluid line 60 to the axial bore of connector 64. The cleaning fluid under pressure enters the central fluid passage 61 of first bolt 51 through radial apertures 63, and then travels into manifold chamber 40 of manifold block 29. The cleaning fluid is then discharged through the spray orifices 44 of spray nozzles 42. Nozzles 42 are in transverse linear alignment and provide a curtain or continuous sheet of fluid directed at an underlying surface and confined by boundaries provided by first scrub brush array 23. The continuous curtain of fluid provides an even distribution of cleaning fluid that serves to loosen the dirt on the surface and, in cooperation with scrub brushes 23 and 26, removes the dirt from the surface. The interruptions or openings in the second scrub brush 26 permit continuity of the linear curtain of fluid provided by nozzles 42.

In construction, cleaning apparatus 10 is easily assembled. Manifold block 29 is snapped into place with respect to housing 11 with shoulders 30, 31 engaged in openings 33, 34 of housing 11. Screws 38 are used to securely fasten manifold block 29 therein. Nozzles 42 are assembled in manifold block 29. The housing 11 is assembled to the peripheral frame 20 of brush assembly 14 with frame 20 situated in the seat provided by ledge 18 and lip 19 of housing 11. Additional screws 22 are used to fasten frame 20 to ledge 18. First and second fastening bolts 51 and 52 are used to assemble yoke 47 to manifold block 29. Fastening bolt 52 also serves as a fluid connection to provide fluid under pressure to the manifold chamber 40. The remaining fluid connections are then provided.

Figure 4:
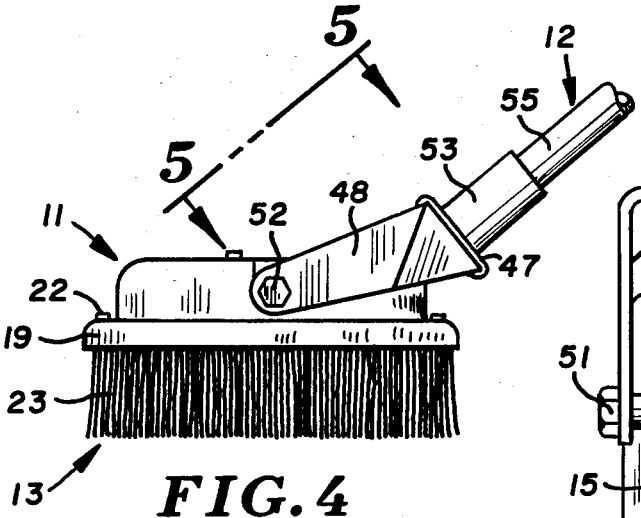
FIG. 4 is a side elevational view of the cleaning apparatus of FIG. 3.
Figure 5:
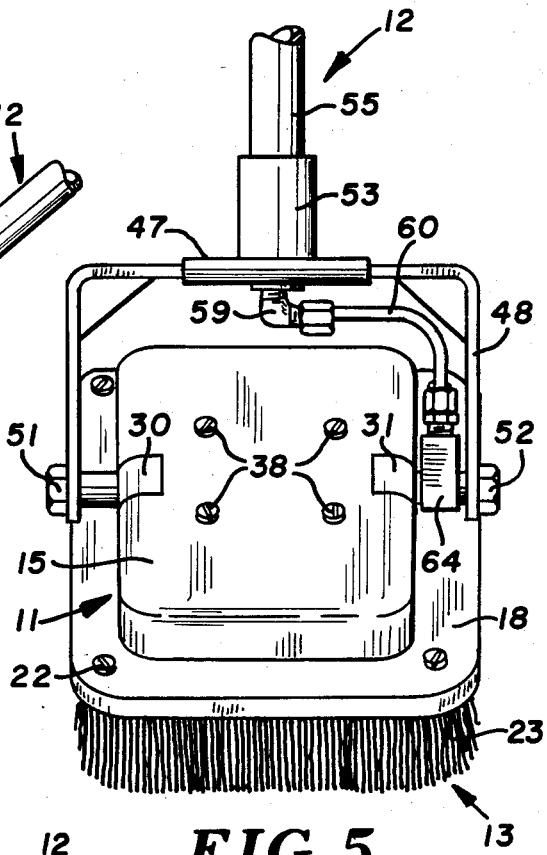
FIG. 5 is a view in elevated perspective of the cleaning apparatus of FIG. 4 taken along the line 5—5 thereof.

As shown in FIG. 4, the axis of handle 55 is offset from the axis of leg 48 of yoke assembly 47. Accordingly, handle 55 can be pivoted with respect to housing 11 to an overcenter position like that shown in FIG. 2, wherein the axis of handle 55 is oriented angularly downward from that of leg 48. In such a configuration, brush assembly 10 has a low profile for use in cleaning under low objects 71, such as a piece of furniture or a cabinet, standing on a support surface 72.

Figure 11:
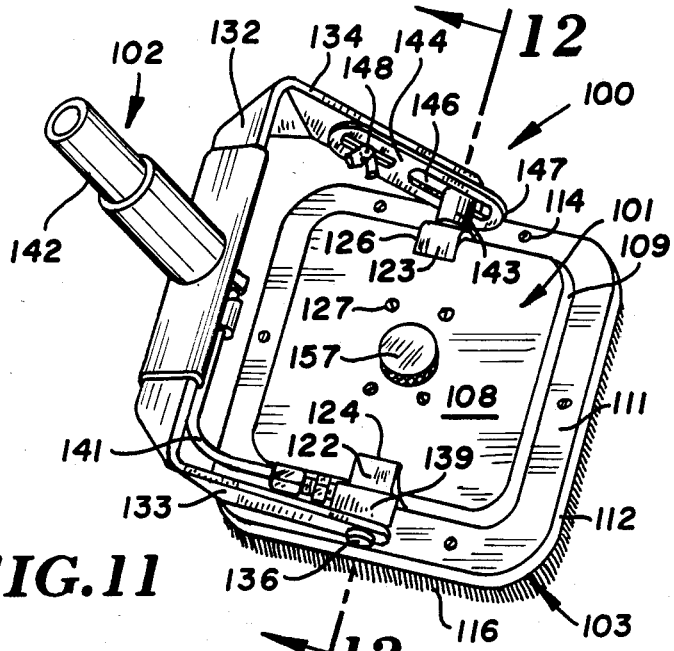
FIG. 11 is a perspective view of a fluid and brush cleaning apparatus according to another form of the invention.
Figure 12:
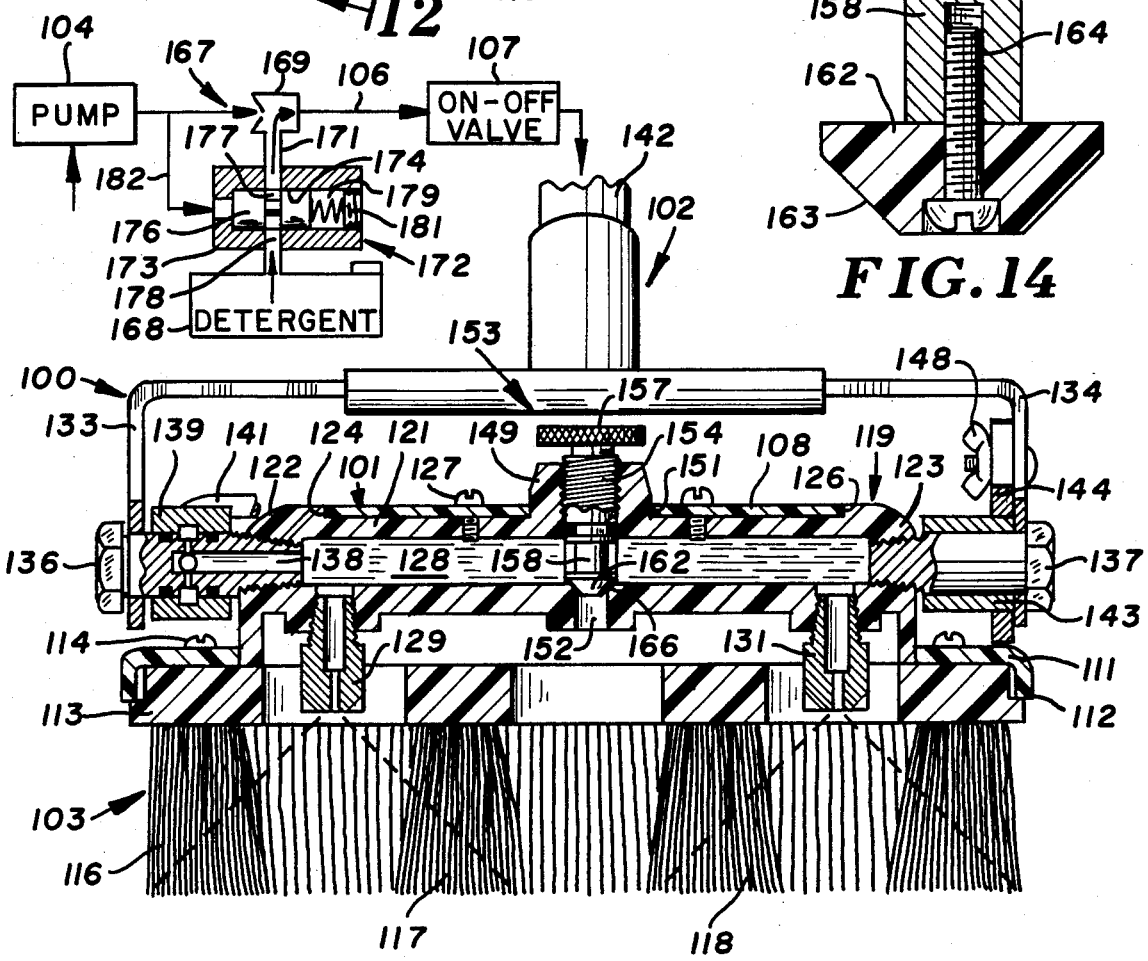
FIG. 12 is an enlarged sectional view taken along the line 12—12 of FIG. 11.

Referring to FIGS. 11 and 12, there is shown a modification of the fluid brush cleaning apparatus indicated generally at 100 operable to scrub a surface, such as flood, wall, ceiling and the like. Apparatus 100 is selectively operable to dispense high pressure cleaning fluid and a mixture of cleaning fluid and detergent onto the surface that is to be cleaned.

Apparatus 100 has a generally square and pan-shaped housing or shroud 101 manipulated by handle assembly 102. A brush assembly 103 is attached to the bottom of housing 101. Brush assembly 103 is the same as brush assembly 13 shown in FIGS. 4, 5, 6 and 9.

Cleaning fluid, such as water, is delivered under high pressure from a pump 104 through a hose or line 106 to tubular handle 142 of handle assembly 102. An on-off valve 107 is located in line 106 to allow the operator to regulate and turn off the flow of cleaning fluid to apparatus 100.

Housing 101 has a generally square top wall 108 joined to downwardly directed continuous side wall 109. An outwardly directed ledge 111 is joined to the bottom of side wall 109. Ledge 111 terminates in a downwardly directed lip 112. Brush assembly 103 has a frame 113 that rests within ledge 111 and lip 112. Frame 113 is identical to the brush frame 20. A plurality of screws 114 secure frame 113 to housing 101.

Brush assembly 103 has a continuous perimeter brush 116 secured to frame 113. Located within the space surrounded by the perimeter brush 116 are a pair of center brushes 117 and 118. The detailed structure of the brush assembly 103 is the same as brush 113 shown in FIGS. 6 and 9.

A manifold assembly 119 is removably mounted on housing 101. Manifold assembly 119 has a block 121 having ends or shoulders 122 and 123 at the opposite ends thereof. The shoulder 122 and 123 fit into openings 124 and 126 in top wall 108 and side wall 109 of housing 101. A plurality of screws 127 secures manifold assembly 119 to top wall 108. Manifold block 121 is snapped into place with respect to housing 101 when shoulders 122 and 123 are located in openings 124 and 126. The relationship between shoulders 122 and 123 and housing 101 locates manifold assembly 119 transversely across housing 101.

Block 121 has an elongated manifold chamber 128 for accommodating the cleaning fluid. A pair of nozzles 129 and 131 are mounted on the lower side of block 121. Each nozzle 129 and 131 are mounted on the lower side of block 121. Each nozzle 129 and 131 has a passage in communication with chamber 128. Nozzles 129 and 131 are positioned to direct a curtain or wall of cleaning fluid under pressure in the area encompassed by brush 116. The dotted lines in FIG. 12 represent the spray pattern of the fluid discharged from nozzles 129 and 131. Nozzles 129 and 131 are conventional spray nozzles.

Handle assembly 102 includes a yoke 132 having a pair of legs 133 and 134. Leg 133 is rotatably mounted on a bolt 136 secured to end of block 121. Leg 134 is rotatably mounted on a bolt 137 threaded into the oppositie end of block 121. Bolt 136 has a central passage 138 open to chamber 128. A sleeve 139 is rotatably mounted on bolt 137. Sleeve 139 has a passage in communication with a tube 141 leading to the lower end of a tubular handle 142 mounted on yoke 132. The bolt 137 and sleeve 139 allow the fluid to flow from tube 141 into chamber 128. Bolt 136 and sleeve 139 are identical to bolt 52 and sleeve 62 as shown in FIG. 10.

A tubular member or spacer 143 is located on bolt 137 between leg 136 and shoulder 123. A lock plate 144 is adjustably mounted on leg 134 to allow handle 142 to be locked in a fixed position or place relative to housing 101. Plate 144 has an elongated slot 146 accommodating spacer 143. The lower end 147 of plate 144 can be moved into engagement with ledge 111 thereby preventing the rotation of handle assembly 102 relative to housing 101. A nut and bolt assembly 148 is operable to clamp plate 144 in a fixed position relative to leg 134. When the plate 144 is in the up position, end 147 is spaced from ledge 111. Handle assembly 102 is free to rotate about 180 degrees relative to housing 101. When plate 144 is moved to the down position, end 147 bears against ledge 111. This prevents the handle assembly 102 from rotating on bolts 136 and 137. Plate 144 can be locked in positions between the up and full down positions thereby handle assembly 102 can have limited amount of rotation relative to housing 101.

Figure 13:
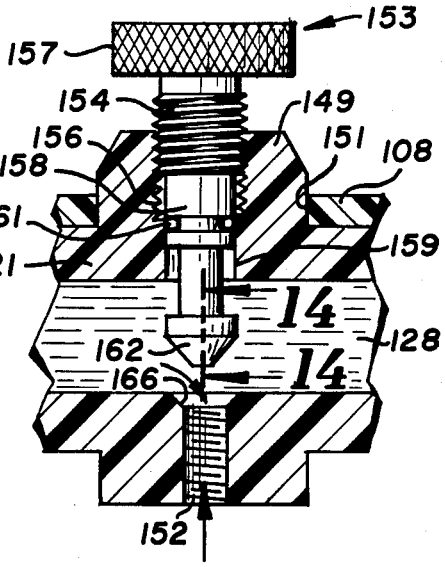
FIG. 13 is an enlarged view of the flow control valve in the open position.

As shown in FIGS. 12 and 13, manifold assembly 119 has a central upright boss 149 projected through a center opening 151 and top wall 108. Boss 149 is aligned with a downwardly directed port or passage 152 aligned with the center of brush assembly 103.

A valve indicated generally at 153 is operable to control the flow of cleaning fluid through port 152. Valve 153 can be moved to a closed position to turn off the flow of fluid through port 152, as shown in FIG. 12. When valve 153 is turned off the pressure of the fluid in chamber 128 increases to substantially the pump pressure. Cleaning fluid under high pressure is discharged from nozzles 129 and 131 as a continuous high pressure curtain of fluid. The pressure of the cleaning fluid in chamber 128 can range between 500 to 1500 psi. The operating characteristics of pump 104 and size of the nozzles 129 and 131 are used to regulate the discharge pressure and volume of the cleaning fluid discharged from nozzles 129 and 13. Manifold block is shown as accommodating two nozzles. The number of nozzles can be increased. Also, a single nozzle can be used to dispense fluid onto the surface to be cleaned. Alternatively, valve 153 can be turned to an open position to allow fluid to flow through port 152 and lower the pressure of the fluid in chamber 128, as shown in FIG. 13.

Figure 14:
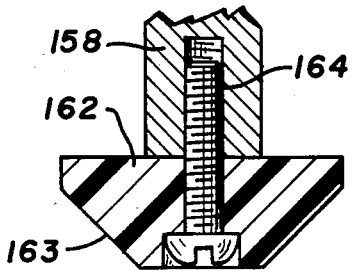
FIG. 14 is an enlarged sectional view taken along the line 14—14 of FIG. 13.

Valve 153 has a threaded body 154 cooperating with threads surrounding bore 156 in boss 149. The upper end of body 154 has an enlarged head or knob 157 to facilitate the manual turning of valve 153 between its open and closed positions. A cylindrical stem 158 extends downwardly from body 154 through a cylindrical bore 159 in the top of block 121. An O-ring 161 mounted on stem 158 cooperates with the wall of cylindrical bore 159 to form a seal between block 121 and stem 158. A cone-shaped valve element or washer 162 is attached to the lower end of stem 158. As shown in FIGS. 13 and 14, washer 162 has an outer cone-shaped face 163. Washer 162 can be made of plastic, metal or the like durable material. A bolt 164 mounts washer 162 on the bottom of stem 158. As shown in FIGS. 12 and 13, the block 121 has a downwardly and inwardly tapered annular seat 166 aligned with the axis of valve 163 so that when valve 153 is in the closed position, cone-shaped face 163 of washer 162 is in surface engagement with the annular tapered seat 166 thereby closing port 152.

As shown in FIG. 12, a detergent control indicated generally at 167 is connected to line 106 leading from pump 104. Control 167 is operable to control the flow of liquid detergent, sanitizer and the like from a container or tank 168 into the fluid flowing in line 106. A venturi connector 169 is located in line 106. A tube or hose 171 joins connector 169 to detergent container 168 to allow detergent from container 168 to flow into line 106. The flow of fluid from pump 104 through connector 169 establishes a suction pressure that draws the liquid detergent from container 168 into line 106.

The flow of detergent from container 168 through the line 171 is controlled by a valve assembly 172. Valve assembly 172 has a body 173 having a bore 174. A spool or valving member 176 having an annular central groove 177 slidably located in bore 174. Body 173 has a passage 178 normally aligned with groove 177 for allowing detergent to flow through the valve assembly 172 to venturi connector 169. A coil spring 179 biases spool 176 to the open position. A cap or plug 181 threaded into body 173 holds spring 179 in engagement with spool 176. A line or tube 182 connects line 106 to valve assembly 172. When the pressure of the fluid output of pump 104 exceeds a selected high pressure limit, spool 176 will be moved to its closed position against the biasing force of spring 179. This blocks the flow of detergent to connector 169 and line 106. The fluid and brush cleaning apparatus 100 is used to perform a high pressure brush and rinse operation.

The detergent is introduced into the cleaning fluid in response to reduced pressure or low pressure of the fluid in the system. The valve 153 is turned to the open position. This is done by turning knob 157. This opens port 152. The fluid in manifold 128 is free to flow through port 152 onto the surface surrounded by brush 116 thereby reducing the pressure of the fluid in manifold 128 and line 106. The pressure of the fluid in chamber can be reduced to below 100 psi. Spring 179 will move spool 176 to the open position. The rapidly moving fluid through venturi connector 169 will draw detergent from container 168 into the fluid flowing through line 106. The fluid travels through the passage in tubular handle 142 and is delivered via the line 141 and passage 138 to manifold chamber 128. The fluid being under pressure is discharged through nozzles 129 and 131 onto the surface to be cleaned. The nozzles 129 and 131 provide a curtain or continuous sheet of fluid directed to an underlying surface confined by the boundaries provided by the brush 116. The continuous curtain of cleaning fluid provides an even distribution of fluid serves to loosen the dirt on the surface. The brushes 116, 117 and 118 concurrently scrub the surface. Valve 153 allows the operator to apply detergent to cleaning fluid. This is done by turning the valve knob 157 to its open position as shown in FIG. 13. Valve 153 can be turned to the closed position as shown in FIG. 12. This blocks port 152 and cuts off the supply of detergent to the line 106. The cleaning fluid will be discharged under high pressure from nozzles 129 and 131 thereby to scrub and rinse the surface.

While there has been shown and described two embodiments of a fluid and brush cleaning apparatus according to the invention, modifications and changes in structure may be made without departing from the invention. The invention is defined in the following claims.

The embodiments of the invention in which an exclusive property or privilege is claimed are defined as follows:

1. A fluid and brush cleaning apparatus comprising: housing means having a top wall and a continuous sidewall joined to the top wall to define a housing interior with a housing opening positionable in facing relationship to a surface to be cleaned; a manifold assembly including a manifold block mounted to the housing means and located in the housing interior, said housing top wall and sidewall have a first mounting opening and a second mounting opening opposite the first mounting opening; said manifold block having a first shoulder at one end thereof, and a second shoulder at the opposite end thereof, said first and second shoulders being positionable in the first and second mounting openings of the housing top wall and sidewall to mount the manifold block with respect to the housing means, said manifold block having an elongate manifold chamber for accommodating fluid under pressure and a port open to the manifold chamber and the housing interior to allow the fluid in the chamber to flow into the housing interior and valve means mounted on the manifold block selectively operable to open and close said port whereby when the valve means is open the pressure of the fluid in the chamber is reduced and when the valve means is closed the pressure in the chamber is increased, a plurality of spray nozzles mounted on the manifold block, each nozzle having a spray orifice in communication with the manifold chamber and directed toward the housing opening, said nozzles being spaced apart and adapted to provide a continuous curtain of spray fluid across the housing interior toward the housing openings; means securing the manifold block to said top wall; a scrub assembly mounted on the housing means providing an outer brush array in substantially continuous surrounding relationship to said opening of the housing means, and an inner brush array having one portion located on one side of said spray nozzles and another portion located on the opposite side of said spray nozzles; a handle assembly connected to the manifold assembly for manual manipulation of the cleaning apparatus; and means to add detergent to the fluid when the valve means is open comprising a container for storing detergent, means to draw detergent from the container and mix the detergent with the fluid, and a valve operable in response to low fluid pressure to allow detergent to flow to the means to draw detergent from the container and operable in response to high fluid pressure to stop detergent flow to the means to draw detergent from the container.

2. The apparatus of claim 1 wherein: said handle assembly includes a transverse yoke, a first leg and a second leg, each leg being connected at one end to the transverse yoke, said first leg being pivotally connected at the opposite end to the first shoulder of the manifold block, said second leg being pivotally connected at the opposite end to the second shoulder of the manifold block, and an elongate tubular handle connected to the yoke and extending outwardly therefrom away from the housing means.

3. The apparatus of claim 2 wherein: said first leg is connected to the first shoulder of the manifold block by a first bolt, said second leg being connected to the second shoulder of the manifold block by a second bolt, said first bolt having a fluid passage in communication with the manifold chamber to provide fluid under pressure to the manifold chamber.

4. The apparatus of claim 3 wherein: said handle of the handle assembly is an elongate tubular member having an axial fluid passage, the outer end of said handle being connectable to a fluid line, the end of the handle being connected to the yoke being connected to one end of a fluid delivery line, the other end of the fluid delivery line being connected to the first bolt for communication with the fluid passage of the first bolt.

5. The apparatus of claim 4 wherein: said handle has an elongate tubular axis angularly offset from the first and second legs.

6. The apparatus of claim 1 wherein: said brush assembly includes a frame with an outer peripheral open frame member shaped to conform substantially to the housing opening and attached to the housing means along the housing opening, said outer brush array being located on said perpheral frame member, rib structure extending inward from the outer frame member and carrying an inner frame member, said inner brush array being attached to said inner frame member.

7. The apparatus of claim 6 wherein: said housing means includes a pan-shaped housing having said top wall joined to the continuous sidewall, a ledge outwardly extended from the edge of the sidewall opposite the top wall, and a lip extended from the outer edge of the ledge parallel to and away from the sidewall, said ledge and lip forming a seat for the outer peripheral frame member of the brush assembly.

8. The apparatus of claim 1 wherein: said brush assembly includes a frame with an outer peripheral open frame member shaped to conform substantially to the housing opening and attached to the housing means along the housing opening, said outer brush array being located on said peripheral frame member, rib structure extending inward from the outer frame member and carrying an inner frame member, said inner frame member carrying the inner brush array.

9. The apparatus of claim 8 wherein: said housing means includes a pan-shaped housing having said top wall joined to the continuous sidewall, a ledge outwardly extended from the edge of the sidewall opposite the top wall, and a lip extended from the outer edge of the ledge parallel to and away from the sidewall, said ledge and lip forming a seat for the outer peripheral frame member of the brush assembly.

10. The apparatus of claim 1 wherein: the valve has a valving member subject to the fluid under pressure and biasing means operable to move the valving member to an open position, said valving member being moved to a closed position with high fluid pressure against the force of the biasing means.

11. A fluid and brush cleaning apparatus comprising: housing means having a top wall and a continuous sidewall joined to the top wall to define a housing interior with a a housing opening positionable in facing relationship to a surface to be cleaned, opposite portions of the top wall and side wall having a first opening and a second opening; a manifold assembly including a manifold block mounted to the housing means and located in the housing interior, said manifold block having a first shoulder located in said first opening and a second shoulder located in said second opening, and an elongated manifold chamber extended between said first and second shoulders to accommodate fluid under pressure, said manifold block being connectable to a supply of fluid under pressure, at least one nozzle mounted on the manifold block between said first and second shoulders, said nozzle having a spray orifice in communication with the manifold chamber and directed toward the housing opening, said nozzle adapted to provide a curtain of fluid across the housing interior toward the housing opening; means securing the manifold block to said top wall; a scrub brush assembly mounted on the housing means providing an outer brush array in substantially continuous surrounding relationship to said opening of the housing means, and an inner brush array having a first brush portion located on one side of said nozzle and a second brush portion located on the opposite side of said nozzle; and means for manipulating the cleaning apparatus to perform a cleaning function.

12. The apparatus of claim 11 wherein: the means for manipulating the cleaning apparatus comprises a handle assembly having a transverse yoke, a first leg, and a second leg, each leg being connected at one end to the transverse yoke, said first leg being pivotally connected at the opposite end to the first shoulder of the manifold block, said second leg being pivotally connected at the opposite end to the second shoulder of the manifold block, an elongated tubular handle connected to the yoke and extending outwardly therefrom away from the housing means.

13. The apparatus of claim 12 wherein: said first leg is connected to the first shoulder of the manifold block by a first bolt, said second leg being connected to the second shoulder of the manifold block by a second bolt, said first bolt having a fluid passage in communication with the manifold chamber to provide fluid under pressure to the manifold chamber.

14. The apparatus of claim 13 wherein: said handle of the handle assembly is an elongated tubular member having an axial passage for accommodating fluid under pressure, the outer end of said handle being connectable to a fluid supply line, the end of the handle being connected to the yoke being connected to one end of a fluid delivery line, the other end of the fluid delivery line being connected to the first bolt for communication with the fluid passage of the first bolt.

15. The apparatus of claim 11 wherein: said brush assembly includes a frame with an outer peripheral open frame member shaped to conform substantially to the housing opening and attached to the housing means along the housing opening, said outer brush array being located on said peripheral frame member, rib structure extending inward from the outer frame member and carrying an inner frame member, said inner frame member carrying the inner brush array.

16. The apparatus of claim 11 wherein: said housing means includes a pan-shaped housing having said top wall joined to the continuous sidewall, a ledge outwardly extended from the edge of the sidewall opposite the top wall, and a lip extended from the outer edge of the ledge parallel to and away from the sidewall, said ledge and lip forming a seat for the outer peripheral frame member of the brush assembly.

17. The apparatus of claim 11 wherein: said manifold block has a port open to the manifold chamber and the housing interior to allow the fluid in the chamber to flow into the housing interior, and valve means mounted on the manifold block selectively operable to open and close said port whereby when the valve means is open the pressure of the fluid in the chamber is reduced and when the valve means is closed the pressure in the chamber is increased.

18. The apparatus of claim 17 including: means to add detergent to the fluid when the valve means is open.

19. The apparatus of claim 18 wherein: the means to add detergent includes a container for storing detergent, means to draw detergent from the container and mix the detergent with the fluid, and a valve operable in response to low fluid pressure to allow detergent to flow to the means to draw detergent from the container and operable in response to high fluid pressure to stop detergent flow to the means to draw detergent from the container.

20. The apparatus of claim 19 wherein: the valve has a valving member subject to the fluid under pressure and biasing means operable to move the valving member to an open position, said valving member being moved to a closed position with high fluid pressure against the force of the biasing means.

21. The apparatus of claim 11 including: a fluid outlet port in the manifold block, and valve means associated with the manifold block operable to a first position to open the port to allow fluid to flow from the manifold chamber thereby reducing the pressure of the fluid in the manifold chamber and to a second position to block the flow of fluid through said port and thereby increasing the pressure of the fluid in the manifold chamber.

22. A fluid cleaning apparatus comprising: housing means having a top wall and a continuous sidewall joined to the top wall to define a housing interior with a housing opening positionable in facing relationship to a surface to be cleaned, a manifold assembly including a manifold block mounted on the housing means and located in the housing interior, said manifold block having a first shoulder at one end thereof, a second shoulder at the other end thereof, an elongated manifold chamber to accommodate fluid under pressure, said block having an outlet port allowing fluid to flow from said manifold chamber into the housing interior, valve means operable to selectively open and close said port to control the flow of fluid through said port, said manifold block being connectable to a supply of fluid under pressure, at least one nozzle mounted on the manifold block said nozzle having an opening in communication with the manifold chamber and directed toward the housing opening, said nozzle being spaced from the port and adapted to provide a curtain of fluid across the housing interior toward the housing opening and onto the surface to be cleaned, means for manipulating the cleaning apparatus for performing a cleaning function, and means to add detergent to the fluid when the valve means is open comprising a container for storing detergent, means to draw detergent from the container and mix the detergent with the fluid, and a valve operable in response to low fluid pressure to allow detergent to flow to the means to draw detergent from the container and operable in response to high fluid pressure to stop detergent flow to the means to draw detergent from the container.

23. The apparatus of claim 22 wherein: the means for manipulating the cleaning apparatus comprises a handle assembly having a transverse yoke, a first leg, and a second leg, each leg being connected to the transverse yoke, first means pivotally connecting said first leg to the first shoulder of the manifold block, second means pivotally connecting said second leg to the second shoulder of the manifold block, and an elongated tubular handle connected to the yoke and extended outwardly therefrom away from the housing means.

24. The apparatus of claim 23 wherein: the first means includes a first bolt pivotally connecting the first leg to the first shoulder, and the second means includes a second bolt pivotally connecting the second leg to the second shoulder, said first bolt having a passage in communication with the manifold chamber to provide fluid under pressure to the manifold chamber.

25. The apparatus of claim 24 wherein: said handle of the handle assembly is an elongated tubular member having an axial passage for accommodating fluid under pressure, said handle having an outer end connectable to a fluid supply line and an inner end connected to the yoke, a fluid delivery line connecting the inner end of the handle to the first bolt for carrying fluid under pressure to the fluid passage of the first bolt and supplying fluid under pressure to the manifold chamber.

26. The apparatus of claim 22 wherein: the valve has a valving member subject to the fluid under pressure and biasing means operable to move the valving member to an open position, said valving member being moved to a closed position with high fluid pressure against the force of the biasing means.

27. A fluid and brush apparatus comprising: housing means having walls forming a housing interior and edges defining a housing opening positionable in facing relationship to a surface to be cleaned, a manifold assembly having a block mounted in spanning relationship to the housing interior, said block having a manifold chamber to accommodate fluid under pressure, and fluid outlet port open to the chamber, valve means operable to selectively open and close said port to control the flow of fluid through said port, a plurality of nozzles mounted on said block in communication with said chamber, each of said nozzles having a fluid discharge orifice directed toward the housing opening to provide a continuous curtain of fluid across the housing interior toward the housing opening, means securing the manifold block to one of said walls of the housing means, scrub brush means continuously disposed about the housing edges defining the housing opening, means for manipulating the cleaning apparatus to perform a cleaning function and means to add detergent to the fluid when the valve means is open comprising first means for storing detergent, second means to draw detergent from the first means and mix the detergent with the fluid, and a valve operable in response to low fluid pressure to allow detergent to flow to the second means to draw detergent from the first means and operable in response to high fluid pressure to stop detergent flow to the second means to draw detergent from the first means.

28. The apparatus of claim 27 wherein: said walls of the housing means have a first opening and a second opening opposite the first opening, said manifold block having a first shoulder at one end thereof and a second shoulder at the opposite end thereof, said first and second shoulders being positionable in said first and second openings to mount the manifold block on the housing means.

29. The apparatus of claim 28 wherein: the means for manipulating the cleaning apparatus comprises a handle assembly having a first leg and a second leg, first means pivotally connecting the first leg to the first shoulder of the manifold block, and a second means pivotally connecting the second leg to the second shoulder of the manifold block, and an elongated handle connected to said legs.

30. The apparatus of claim 29 wherein: said first means has a fluid passage in communications with the manifold chamber to provide a fluid under pressure to the manifold chamber.

31. The apparatus of claim 30 wherein: said handle is an elongated tubular member having an axial passage for accommodating fluid under pressure, the outer end of the handle being connectable to a fluid supply line, said handle having an inner end, a fluid delivery line being connected to the inner end of the handle and the first means for carrying fluid under pressure from said axial passage of the tubular member to said fluid passage of the first means.

32. The apparatus of claim 27 wherein: said scrub brush means includes a frame with an outer peripheral open frame member shaped to conform substantially to the housing opening and attached to the housing means along the housing opening, said brush means having an brush array located on said peripheral frame member and an inner frame member, and an inner brush array mounted on the inner frame member, said inner brush array having a first brush portion located on one side of the nozzles and a second brush portion located on opposite sides of said nozzles.

33. The apparatus of claim 27 wherein: said housing means includes a pan-shaped housing having a top wall joined to a continuous sidewall, a ledge outwardly extended from said sidewall opposite the top wall, and a lip extended from the outer edge of the ledge, said lip being located generally parallel to and outwardly from said sidewall, said ledge and lip forming a seat for the scrub brush means, and means securing the scrub brush means to said ledge.

34. The apparatus of claim 27 wherein: the valve has a valving member subject to the fluid under pressure and biasing means operable to move the valving member to an open position, said valving member being moved to a closed position with high fluid pressure against the force of the biasing means.

* * * * *